United States Patent [19]

Duguet et al.

[11] 3,956,038

[45] May 11, 1976

[54] PROCESS FOR OBTAINING COATED PYROTECHNIC COMPOSITIONS

[75] Inventors: Jean Renè Duguet, Sarniguet; Marie Louise Sanmartin, Semeac, both of France

[73] Assignee: Etat Francais, Paris, France

[22] Filed: Mar. 14, 1974

[21] Appl. No.: 451,150

[30] Foreign Application Priority Data

Mar. 15, 1973 France ..... 73.09221

[52] U.S. Cl. ..... 149/4; 149/6; 149/7; 149/8; 149/11; 149/12

[51] Int. Cl.[2] ..... C06B 45/36

[58] Field of Search ..... 149/6, 7, 8, 4, 11, 149/12

[56] References Cited

UNITED STATES PATENTS

| | | | |
|---|---|---|---|
| 3,373,062 | 3/1968 | Morris | 149/6 |
| 3,480,488 | 11/1969 | Rudy et al. | 149/6 X |

*Primary Examiner*—Stephen J. Lechert, Jr.
*Attorney, Agent, or Firm*—Haseltine, Lake & Waters

[57] ABSTRACT

Pyrotechnic compositions having a decreased susceptibility to external influences are obtained by suspending pyrotechnic particles in a dilute solution of a coating polymer and adding a second polymer which is more soluble in the solvent, so that microdroplets of the coating polymer are formed, completely enclosing the pyrotechnic particles. The coated particles are hardened by exposure to air, optionally in the presence of a hardening catalyst.

10 Claims, No Drawings

PROCESS FOR OBTAINING COATED PYROTECHNIC COMPOSITIONS

BACKGROUND OF THE INVENTION

The present invention has as its object improved powdered pyrotechnic materials and a process for the preparation of such substances. More particularly, the invention has as its object powdered pyrotechnic materials which are less sensitive to external influences, such as mechanical, electric, thermal etc. and a process for their preparation.

Pyrotechnic materials are understood to include pure powdered explosive chemical compounds and pyrotechnic compositions. A pyrotechnic composition is a composition capable of reacting exothermically under the effect of a pyrotechnic or non-pyrotechnic phenomenon to produce a specific effect such as flame, light or sound, evolution of smoke or gas, etc. The pyrotechnic compositions of the invention, more particularly, but not exclusively are priming, conducting, retarding, gas-generating, illuminating, or smoke-producing.

The compositions comprise firstly primary or primary and secondary explosives and secondly, optionally, conducting, oxidizing or reducing additives.

The pure powdered explosive chemical compounds most particularly concerned are primary explosives, that is explosives which are easily detonated by a slight external force which can be mechanical, electrical or thermal etc.

The currently available primary explosives have a very high sensitivity, much higher than necessary. This is a major inconvenience, in certain cases, this excessive sensitivity prevents any handling for charging pyrotechnic devices and makes the correct utilization of these devices very delicate.

In addition to their excessive sensitivity the primary explosives now in use have the disadvantages inherent in powdered products. Their low variable density does not favor any satisfactory volumetric charging of the devices, the flowability is mediocre; these powdered products contain "fines" (that is, small particles) which have the tendency to disperse easily in the atmosphere and to form dangerous dusts; moreover, the reproducibility of pyrotechnic characteristics from one preparation to another is very difficult to obtain.

Attempts have been made in the prior art to reduce the sensitivity of primary explosives; they consist, notably, in introducing during the synthesis of the explosive, such as lead nitride, inert substances such as dextrin, the sodium salt of carboxymethylcellulose, polyvinyl alcohol etc. This addition has the serious disadvantage of producing a decrease in performance and to render more difficult the reproducibility of the pyrotechnic characteristics from one preparation to another.

It is also known in this art to reduce the sensitivity of powdered substances and to improve their pyrotechnic characteristics by coating the powder particles with a polymeric binder. This coating method consists of mixing the explosive particles with a solution of a polymer and evaporating the solvents. By this method are obtained non-homogeneous products of a very mediocre quality; there is obtained a more or less compact mass which is then subjected to suitable mechanical processes to effect granulation. This process is not satisfactory because there is obtained a mixture of coated particles having on their surface free crystals of the explosive and/or incompletely coated particles.

U.S. Pat. No. 3,646,174 describes a process for obtaining spheroidal particles coated with an organic polymer. This process comprises the steps of mixing solid particles with a liquid organic prepolymer which can be transformed into a solid polymer, and a volatile liquid which is non-miscible with the prepolymer, of agitating the resultant mixture and simultaneously evaporating the volatile liquid to form spheroidal globules of liquid prepolymer containing the particles; the last step consists of continuing the agitation and removal of the volatile liquid until the prepolymer is transformed into a solid polymer to form spheroidal agglomerates of said solid particles in an organic polymer matrix. This patent is illustrated by examples in which it is specified that 95 percent of the particles having a particle size of 2 to 3 microns are coated, the dimension of the spheroids being between 0.3 and 1 mm.; this value of 5 percent of non-coated particles cannot be tolerated in coating primary explosives, if it is desired to control their sensitivity effectively.

In the case of a primary explosive, the presence of a single non-coated or non-uniformly coated particle cannot be tolerated; in effect the sensitivity of the explosive would then be reduced to the intrinsic sensitivity of the basic explosive and the coating process would be rendered useless.

The present invention overcomes the above-mentioned disadvantages.

SUMMARY OF THE INVENTION

The invention has as its object a powdered pyrotechnic material consisting of free particles characterized in that all of said particles comprise one or several particles of a pyrotechnic material of a size less than 500 microns coated with a polymeric binder and have a continuous curved closed convex surface, the minimum sensitivity to friction being greater than 150 g, the ratio of the extreme dimensions of a particular preparation varying within 2/1.

It should be noted that for the materials of the prior art, this ratio was 10/1. For industrial lead nitride the minimum sensitivity to friction under the same conditions is about 10 g. Another object of the invention is a material as described above in which 98 percent of the particles have a spherical shape.

The substances according to the invention exhibit a very clearly lower sensitivity to mechanical, electrical, theremal etc. influences without disturbing their explosive characteristics. The risks of accident are diminished by this fact in the course of conditioning and charging and it becomes possible to use them under much more severe environmental conditions and strains, previously impossible because of physico-chemical degradation.

Besides, the primary explosives obtained according to the invention are in the form of non-hygroscopic powders consisting of spherical grains with a smooth surface. These powders are distinguished from known powders by a larger, perfectly regular apparent density and in which the extremely reduced friction between the grains facilitates the flow through charging sieves as well as the formation of homogeneous mixtures; the grain size is easily controllable according to the regulated parameters during preparation; their characteristics can be reproduced from one preparation to another and their pyrotechnic performance is at least equal to that of the base product before coating. Another object of the invention is a process for the preparation of these powdered pyrotechnic substances comprising the following steps:

- preparation of a dilute solution of the coating polymer in an ionic or non-ionic solvent at a concentration of 2 to 20 percent,
- introduction of 10 to 60 percent by weight of a powdered pyrotechnic substance with suitable agitation to maintain a homogeneous dispersion of the particles,
- progressive addition under agitation of one or more viscous liquid antagonistic polymers for which said solvent has a greater affinity than for said coating polymer to obtain a concentration of between 20 and 60 percent by weight of the total weight of solvent, polymer and pyrotechnic ingredient,
- filtration to separate the plasticized grains from the residual liquid phase,
- washing the grains in order to eliminate all trace of the addition polymer,
- exposing the obtained grains for 2 to 3 hours to air or to the heat of an oven.

The maximum thickness of the coating depends on the concentration of the polymer which is between 2 and 20 percent; the concentration may vary according to the quality of the required protection and the protective properties of the selected polymer.

Of course, the solvent which constitutes the dispersion medium may be an ionic solvent or non-ionic solvent; nevertheless it should be chosen so that there is no chemical reaction at all or so that it is not incompatible with the particles of the pyrotechnic substances to be coated.

The quantity of addition polymer also varies with the nature and concentration of the coating polymer as well as with the nature of the solvent used. The coating polymer separates progressively from its solution in the form of micro-droplets of uniform size in which the particles of explosives find themselves imprisoned.

The uniformity of the size of the coated grains is controlled by the nature and speed of agitation.

The deposit of the coating polymer continues until the complete separation from its initial phase. Although it is not indispensable, the use of a curing catalyst for the coating polymer allows the hardening of the caoting to be thoroughly completed. This optional catalyst is introduced at the end of the operation.

DESCRIPTION OF PREFERRED EMBODIMENTS

The dimension of the particles to be coated constitutes an important factor. Relatively large particles of 50 to 500 microns undergo a simple plastic coating without appreciable change in form. On the other hand, fine particles of 50 microns agglomerate and enter the uniform micro-droplets of the coating polymer which separates progressively from the solvent, deposits on the particles forming grains, which, if they are not entirely spherical, nevertheless exhibit very rounded forms without roughness. Thus it can be seen how important it is to choose the maximum size of the particles not to exceed 50 microns in order for the process to be completely effective. The particles to be coated may be of the same type or they may be of different types, as for example, ultrafine particles of lead nitride and oxidizing or reducing particles and/or electrically conducting particles to modify, if necessary, the pyrotechnic properties of the product obtained, providing they have a similar particle size. In this case, the polymer matrix includes a homogeneous reproducible mixture of the pyrotechnic composition. This permits replacing advantageously the mixing techniques for powders practiced industrially, which are not without danger and without risk of rejection because of the mediocre quality of the mixture obtained.

According to the intended use of the substance, the explosive particles introduced will be either primary (of high sensitivity), or secondary, but it is also possible to introduce at the same time, particles of both types when it is desired to obtain grains of a determined sensitivity weaker than that of the primary explosive alone, while conserving an excellent potency in the obtained composition. This is possible providing that the two types of explosive particles are physico-chemically compatible and that care is taken to choose a solvent which meets the conditions of the invention and moreover does not dissolve the secondary explosive, which is true of ketones.

The primary particles may be selected from the group of lead nitride or lead styphnate, etc., as well as from the groups of known primary explosives including copper chlorotetrazolate silver nitride, cadmium nitride, silver acetylide etc. Thus a series of particularly interesting products are made available which have not been able to be made industrially either because of the dangers incurred, or bacause of too fine crystallization which makes them unsuitable for charging.

The secondary explosive particles may be chosen as well from among the most current Pentrite and Hexogen* etc., for example, as from the thermostable type of secondary explosives, hexanitrostilbene or those known from the current abbreviation TACOT and DIPAM for example, with the provision of compatibilities as in the case of plastification of a mixture comprising primary and/or secondary explosives.

*Pentrite is a trade name for pentaerythritol tetranitrate, also known as PETN. Hexogen is a trade name for cyclo-trimethylene-trinitramine, also known as cyclonite and RDX.

The oxidizing particles may be chosen among the compounds employed industrially in pyrotechnics: such as, notably, sodium nitrate, potassium chlorate etc. Obviously they may be utilized in the process of the invention either separately or in a mixture in order to meet the specific needs as specially lowering the hygroscopicity etc.

The reducing particles will also be chosen among the compounds usually employed industrially in pyrotechnics.

The reducers, such as for example zirconium, can be coated in liquid phase alone or in a mixture. In addition to the intra- and intergranular homogeneity of the composition obtained, the risk of inflammability dissappears due to isolation from ambient air; this permits the use of the pyrotechnic substances according to the invention under controlled aggressive conditions whereas pyrotechnic substances of the prior art used under these conditions undergo all kinds of degradation.

The electrically conducting particles may be either metallic or graphitic. With regard to the metallic particles, the metals used are no longer limited because of metallic diffusion or inflammability. If suffices to coat separately the pyrotechnic substance or the metal in the second case. These particles may be chosen from the following group: aluminum, copper, magnesium, gold, silver, graphite etc.

The present invention thus includes any pyrotechnic mixture or composition: retarding composition, priming composition, conducting composition, gas generating composition, illuminating composition, smoke-producing composition . . . these compositions being in the form of rounded regular grains with a homogeneous and reproducible composition.

The polymer intended to coat the particles may either be dissolved directly in the solvent, as for example in the case of a polyester, or as its constituents, as in the case of a polyurthane, the mixture of diisocyanate polyol being then introduced in suitable proportions.

The coating material for the particles may be any rigid plastic currently on the market, such as polyester, polyurethane, which confer on the product a good resistance to mechanical stresses, as well as flexible, porous or impermeable polymers, such as silicone elastomers, ethyl celluloses, polyamides, etc. depending on the specific use; polyimide polymers for example will form an impermeable matrix highly resistant to temperature; polymers having an explosive character of the type known as nitrocelluloses can be employed with the object of increasing the potency of the material, with the provision of eventual compatibility.

Obviously, for each case it is necessary to use a solvent and a suitable antagonistic polymer.

For example, if the coating polymer is selected from the group of polyester, polyurethane, poly(methyl methacrylate), phenol formaldehyde resins, etc., the solvent will be chosen from the group of ketones having a branched or linear short carbon chain and the antagonistic polymer from silicone oils of the poly(dimethyl siloxane) type.

For an explosive polymer of the nitrocellulose type, the solvent is chosen from the group of esters having a short carbon chain and the antagonistic polymer from the group of isocyanates or polystyrene.

Also included in the scope of the invention are also changes in the nature of the polymers, the solvents, the catalysts, the additives etc. as well as all modifications of the process within the limit of equivalents.

EXAMPLE 1

Into a beaker under mild agitation were added 10 ml. of a 5 percent solution of a polyol-diisocyanate mixture in methyl ethyl ketone; the diisocyanate used was toluene diisocyanate in the form of a polyisocyanate by combination with a trifunctional alcohol, as a 75 percent solution in ethyl acetate, having an NCO content of about 30 percent.

The polyol used was a polyester based on dibasic acids and triols, having an hydroxyl content of about 8.8 percent. The polyoldiisocyanate mixture was taken in the respective proportions of 100/165 parts by weight.

5 g of microcrystalline lead nitride — 1 micron of very high purity — were suspended in the solution in the beaker. Then 10 ml. of a silicone oil — poly(dimethylsiloxane) having a viscosity between 100 and 1000 centipoises at 25°C. and preferably containing several free OH groups — were slowly poured into the beaker in the presence of a catalyst — Catalyst C marketed by Société Rhône — Poulenc and consisting of tin dibutyl dilaurate in solution.

The spherical grains obtained were separated by filtration, washing with hexane and drying and finally exposure to air for several hours to complete the cross-linking of the polymer.

EXAMPLE 2

Lead nitride coated with polyester

Into a beaker containing 5 g of ultra-fine lead nitride (1 micron) in suspension in a 5 percent solution of polyester in acetone, were slowly poured with suitable agitation 20 ml of the poly (dimethylsiloxane) described in Example 1. The final treatment was identical to that of Example 1. Examination showed that all the explosive particles were coated and were spherical in form.

EXAMPLE 3

Lead nitride coated with nitrocellulose

Into a 25 ml beaker containing 5 g of ultra-fine dry lead nitride in suspension in a 5 percent solution of nitrocellulose resin containing 12 percent nitrogen were added slowly 15 ml of the poly (dimethylsiloxane) oil as described in Example 1. The final treatment was identical to that of Example 1. All of the explosive particles were coated.

EXAMPLE 4

Primary explosive coated with nitrocellulose

Into a 25 ml beaker containing g of a 70/30 by weight mixture of lead nitride and lead styphnate in a 5 percent acetone solution of nitrocellulose resin containing 12 percent nitrogen were added 15 ml of the poly(methylsiloxane) oil as described in Example 1. The product was washed by decantation with cyclohexane, aired and dried. All of the explosive particles were coated.

EXAMPLE 5

Primary explosive + secondary explosive coated with nitrocellulose

Into a 25 ml beaker containing 5 g of a 70/30 by weight mixture of lead nitride - Pentrite in suspension in a 5 percent acetone solution of nitrocellulose resin containing 12 percent nitrogen were added 15 ml of the silicone oil as described in Example 1. The final treatment was identical to that of Example 1. All of the explosive particles were coated.

Other polymeric coating materials which were found to be suitable but more difficult to use in the present invention were poly(methylmethacrylate) — "Plexiglass" — and phenol formaldehyde resins.

The polyester resin in Example 2 was a bis phenol type resin with a low acid number.

COMPARATIVE EXAMPLE

The following table gives the characteristics of several products according to the invention in comparison with an industrial primary explosive.

The pyrotechnic substance according to the invention finds particularly interesting application in detonators for fuses of artillery projectiles. In fact, in pyrotechnic chains of fuses for shells, a mechanical security device (interruption of the chain, for example, by rotation of a "relay-rotor") in commonly used to avoid accidental priming of the detonator charge under the acceleration effect due to the firing of the shell. The use of the explosives according to the invention in detonators makes it unnecessary to use this mechanical device and affords excellent security during handling and firing.

The process according to the invention makes possible:

obtention of pyrotechnic substances which are less sensitive to mechanical, electrical, thermal or radiation influences, industrial use of an extended range of explosive products which have not been able to be industrially applied until now because of the dangers incurred, realization of pyrotechnic devices, for example detonators, having greater safety, able to undergo without untimely functioning or deterioration strong accelerations and decelerations of the order of several tens of thousands of times the acceleration of gravity.

The improved powdery substances according to the invention can be advantageously used without any modification in existing installations or in processes for charging devices in current pyrotechnic usage: primers, detonators, etc. and in apparatus in which the energy produced acts on a mobile piece to accomplish mechanical work, such as, for example, cutting.

Of course, it is possible to adapt equivalent modifications to the processes which have been described without departing from the scope of the invention.

tion to maintain a homogeneous dispersion of the particles in the coating polymer solution, progressively adding with agitation one or more viscous liquid antagonistic polymers for which said solvent has greater affinity than for said coating polymer to obtain a weight concentration between 20 and 60 percent of the total weight of the solvent, polymer and pyrotechnic substance;

filtering to separate plasticized particles of coated pyrotechnic substance from the residual liquid phase;

washing the separated particles; and hardening the particles by exposure to air or to the heat of an oven for 2 to 3 hours.

2. A process according to claim 1 wherein the particles of pyrotechnic substance introduced into the coating polymer solution have a size less than 50 microns.

3. A process according to claim 3 wherein the pyrotechnic substance comprises a primary explosive.

4. A process according to claim 3 wherein the pyrotechnic substance comprises a secondary explosive.

5. A process according to claim 3 wherein the pyrotechnic substance comprises oxidizing and reducing particles.

| Nature of Product | Percentage of Polymeric Binder | Dimension of Particles | Form of Particles | Apparent Density of the Powder | Sensitivity to Friction (1) | Sensitivity to Flame (2) | Sensitivity to hot wire (3) | Shattering Initiation by Joule Effect (4) |
|---|---|---|---|---|---|---|---|---|
| Industrial Lead Nitride | — | between 20 and 1.50 μ | crystalline aggregates of irregular form | 1.17 | <10 g. | **380 mm | ≃380 mA | 41 g |
| Lead Nitride + polyester | 20 | <20μ | spherical | 1.18 | 200g. | <80 mm | 430 mA | 39.8g |
| Lead Nitride + polyester | 20 | 50<ϕ<100μ | spherical | 1.45 | 400 g. | 180 mm | 450 mA | 40.5g |
| Lead Nitride + polyester | 20 | >100μ | spherical | 1.49 | 200 g. | 390 mm | | 42g |
| Lead Nitride + polyurethane | 10 | 50<ϕ<100μ | spherical | 1.46 | 300 g. | 160 mm | 414 mA | 40.5g |
| Lead Nitride + polyurethane | 10 | >100μ | spherical | 1.42 | 250 g. | 330 mm | 430 mA | 47.6g |
| Lead Nitride + polyurethane | 20 | 50<ϕ<100μ | spherical | 1.32 | 400 g. | 380 mm | 440 mA | 39.0g |
| Lead Nitride + polyurethane | 30 | 50<ϕ<100μ | spherical | 1.33 | 750 g. | 300 mm | insensitive | not initiated |

(1) weight applied on the point and not producing an explosion in 10 tries in the J. Peters apparatus.
(2) maximum distance at which the flame of a standard fuse is capable of igniting the explosive.
(3) intensity of electric current producing the explosion when it flows through a wire embedded in the powdered exposive.
(4) mass of calibrated sand shattered by 400 mg of the explosive studied. The initiation was effected by passage of an electric current through a wire of ϕ 42μ embedded in the explosive.

We claim:

1. A process for preparing a powdered pyrotechnic composition comprising free particles of at least one pyrotechnic substance, all of said particles characterized by having a size less than 500 microns, being coated with a polymeric binder, having a continuous closed curved convex surface, having a minimum sensitivity to friction of 150g., and having a ratio of the extreme dimensions of the particles up to 2/1, said process comprising the steps of:

dissolving the coating polymer in an ionic or nonionic solvent in a concentration of 2 to 20 percent by weight, introducing 10 to 60 percent by weight of a powdered pyrotechnic substance with sufficient agita-

6. A process according to claim 3 wherein the pyrotechnic substance comprises electrically conducting particles.

7. A process according to claim 3 wherein the coating polymer is selected from the group consisting of inert rigid, flexible, thermostable, thermoplastic and thermosetting polymers.

8. A process according to claim 7 wherein the coating polymer is a polyester.

9. A process according to claim 7 wherein the coating polymer is a polyol diisocyanate.

10. A process according to claim 9 wherein the coating polymer is a nitrocellulose.

* * * * *